United States Patent [19]

Takahashi

[11] 4,032,264

[45] June 28, 1977

[54] CLOSED-TYPE ELECTROMAGNETIC COMPRESSOR

[75] Inventor: Shiro Takahashi, Tokyo, Japan

[73] Assignee: Man Design Co., Ltd., Tokyo, Japan

[22] Filed: Dec. 10, 1975

[21] Appl. No.: 639,377

[52] U.S. Cl. ..... 417/417; 62/469; 92/86.5; 417/363; 417/902

[51] Int. Cl.[2] ..... F04B 17/04

[58] Field of Search ..... 417/415, 416, 417, 363, 417/902, 366, 367, 368; 184/6.16, 626, 57; 62/469; 310/24; 418/97, 98, 99; 92/86.5

[56] References Cited

UNITED STATES PATENTS

| | | | |
|---|---|---|---|
| 2,295,124 | 9/1942 | Muffly | 184/6.16 |
| 2,618,430 | 11/1952 | Smith | 417/902 |
| 2,751,145 | 6/1956 | Olcott | 417/415 |
| 2,956,730 | 10/1960 | Hamilton et al. | 417/415 |
| 3,155,312 | 11/1964 | Douglas | 417/415 |
| 3,355,676 | 11/1967 | Omura et al. | 417/416 |
| 3,514,225 | 5/1970 | Monden et al. | 417/367 |
| 3,538,357 | 11/1970 | Barthalow | 417/416 |
| 3,542,495 | 11/1970 | Barthalon | 417/416 |
| 3,685,617 | 8/1972 | Gardner | 184/6.16 |

FOREIGN PATENTS OR APPLICATIONS

| | | | |
|---|---|---|---|
| 1,156,598 | 5/1958 | France | 184/6.16 |

*Primary Examiner*—William L. Freeh
*Assistant Examiner*—Edward Look
*Attorney, Agent, or Firm*—Ostrolenk, Faber, Gerb & Soffen

[57] ABSTRACT

In a closed-type compressor with an electromagnetic reciprocating drive, reliable and stable collimation of the electromagnetic driving part with the compressive pumping part is easily established by a snug engagement of fitting seats provided in the coupling plane of the two parts and lubrication of the piston and its related part is effected by a built-in type lubrication mechanism utilizing the flow of the gas returning from the given circulation system with simplified construction as well as in the case of compressors with rotary drive, the compressor being preferably used for cooling systems.

7 Claims, 7 Drawing Figures

CLOSED-TYPE ELECTROMAGNETIC COMPRESSOR

BACKGROUND OF THE INVENTION

The present invention relates to an improvement in a closed-type electromagnetic compressor, and more particularly relates to improved collimation and lubrication mechanisms in a closed-type (i.e., sealed) compressor preferably used for cooling systems in which both driving and pumping parts reciprocate in the axial direction of the compressor for compressive pumping action.

A closed-type compressor provided with an electromagnetic drive is already known in the art. In the construction of the compressor of this type, at least one stator core is connected via a half-wave rectifier circuit to a given AC source and a magnetic armature is allowed to reciprocate in the axial direction of the compressor across, i.e., substantially at a right angle to the line of magnetic induction generated by the stator core. The armature is integrally coupled with a piston which carries out the pumping action by its reciprocation in the piston chamber. When a pair of axially spaced stator cores are provided, electromagnetic attractions generated by alternate excitation of the two stator cores and acting on the armature cause reciprocation of the piston. Whereas, when only one set of stator core is used, movement of the piston in one direction is caused by the magnetic attraction acting on the armature and movement of the piston in the other direction is caused by a separate urging mechanism acting mechanically on the piston. One typical example of such an urging mechanism is given in the form of a return spring.

However, it is well known that conventional compressors of the above-described type have never been welcomed in the actual field of industry. Major causes for this poor acceptance of the conventional machines in the actual field of industryf are thought to be as follows.

In the case of compressors of the rotary drive type, one end of the crank shaft of the rotary electric motor is immersed within lubrication oil so that the oil is supplied to the shaft bearing parts as the shaft rotates. In another example, a screw pump type oil supply system is used for lubrication.

In contrast to this, the compressor of the above-described reciprocal drive type contains no rotary shaft in its construction and, therefore, the above-mentioned lubrication system employed in the rotary drive type compressors cannot be utilized for lubrication of the reciprocal drive type compressors. This requires provision of a separate oil supply pump in the construction of the reciprocal drive type compressors entailing complicated construction, troublesome maintenance and escalated manufacturing costs.

Further, in the pumping mechanism of the reciprocal drive type compressors, reciprocation of the piston with the armature plays the most important decisive role. So, when the collimations of the armature with the stator core and of the piston with the bearing part are not in order, biased attraction on the armature and/or biased load on the piston has an undesirable influence on the life of the piston and its related parts. In order to obviate such problems, precise collimation must be established between the above-mentioned elements, which in general calls for complicated, time-consuming and highly skilled work in assembling the compressors.

BRIEF DESCRIPTION OF THE INVENTION

It is a principal object of the present invention to provide a closed-type electromagnetic compressor with a reciprocal drive provided with a novel lubrication system of a simple construction.

It is another object of the present invention to provide a closed-type electromagnetic compressor in which reliable and stable collimation of the piston with its related parts can be easily established.

In order to attain the above-described objects, the compressor in accordance with the present invention is provided, in addition to elements common to reciprocal drive type compressors, with means for establishing such a collimation and provided in the coupling plane of the driving part with the pumping part and means for lubricating the sliding plane of the piston within the bearing part of the machine which utilizes the gas flow returning into the compressor from the given gas circulation system.

Although the following explanation is limited to an embodiment in which magnetic attraction is used in combination with spring repulsion for effecting the piston reciprocation, it will be well understood that the present invention is applicable to reciprocal drive type compressors in which alternately generated magnetic attractions are used for effecting the piston reciprocation or in which magnetic attraction is used in combination with mechanical urging devices for the reciprocating piston other than the spring repulsion type.

It should be further noted that the present invention is applicable to any closed-type compressor with an electromagnetic drive in which a magnetic armature reciprocates across the line of magnetic induction, although the following description is limited to the one in which the armature reciprocates across, i.e., substantially at a right angle, the line of magnetic induction.

Further features and advantages of the present invention will be made clearer from the following description, reference being made to the accompanying drawings.

DETAILED DESCRIPTION OF THE INVENTION

In the following description, the terminal side of the compressor along the line of piston reciprocation on which an electromagnetic driving part is located will be referred to with terms "front" and "forward" whereas the terminal side on which a pumping part is located will be referred to with terms "rear" and "rearward."

Further, when reference is made to vertical positional relationship, it is assumed that the compressor is placed in a normal posture with the direction of the piston reciprocation being in a horizontal plane.

Figure 1:
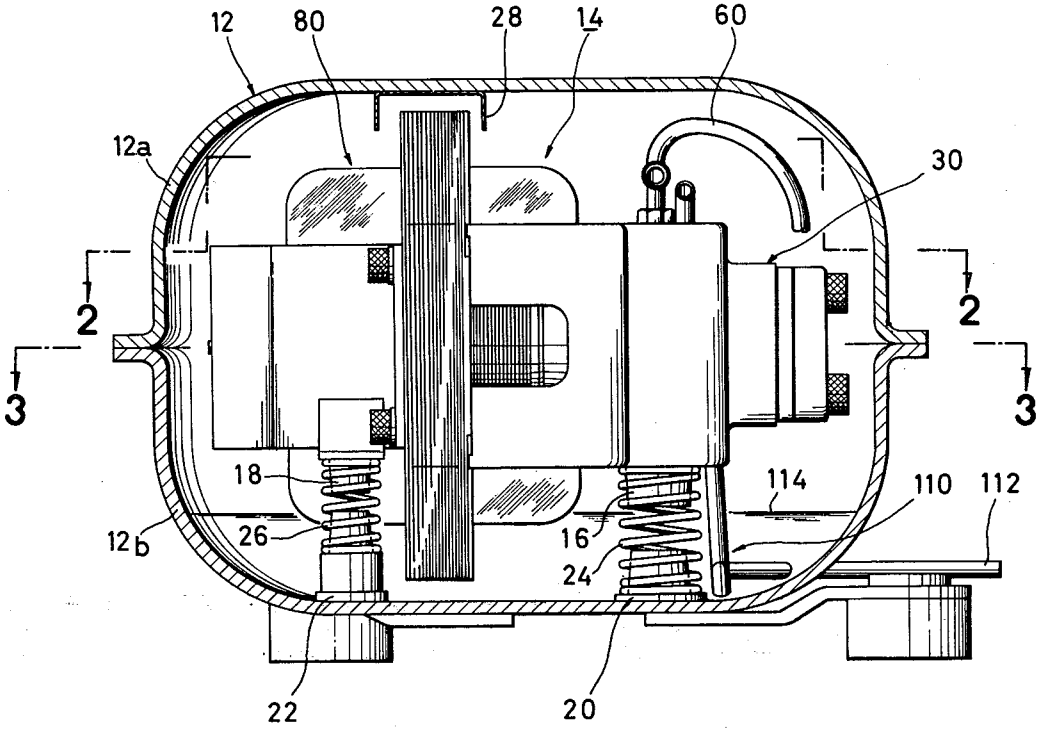
FIG. 1 is a front plan view, partly in section, of embodiment of the closed-type electromagnetic compressor to which the present invention is applied.
Figure 2:
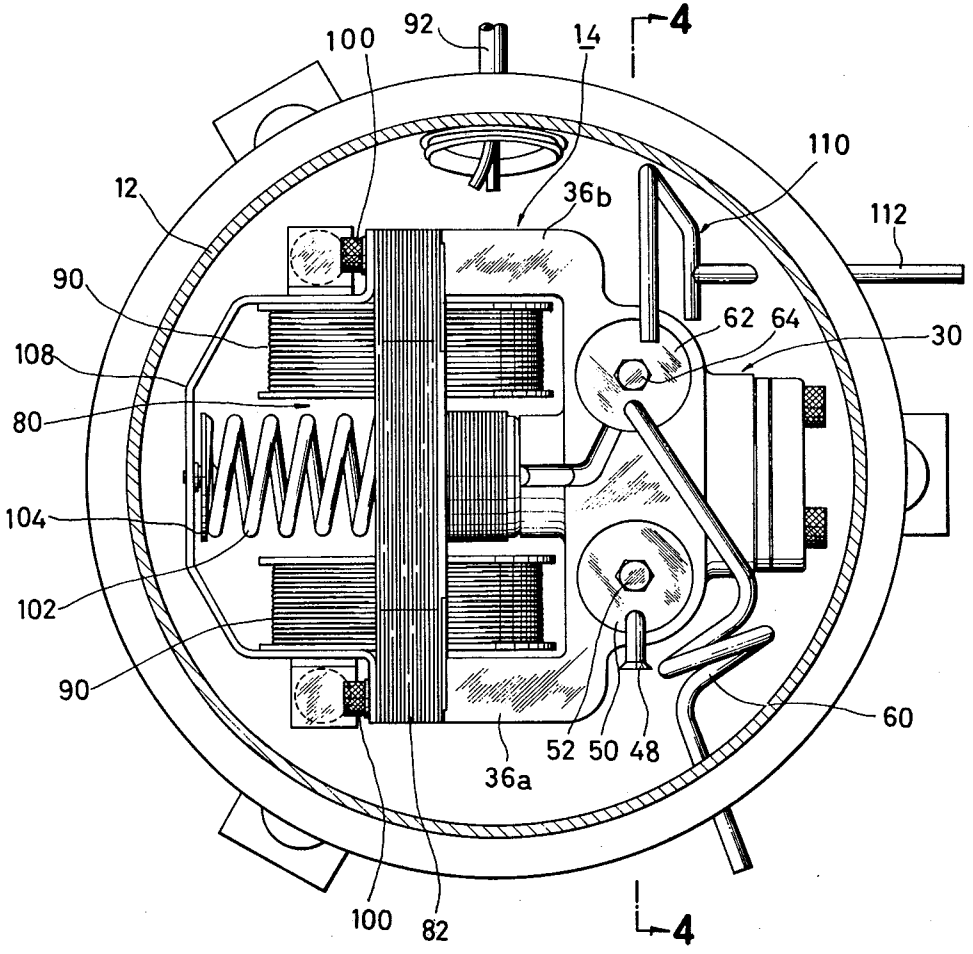
FIG. 2 is a section taken along the line 2—2 in FIG. 1.

As seen in FIGS. 1 and 2, a compressor assembly 14 of the compressor in accordance with the present invention is enclosed within a closed casing 12 made up of upper and lower halves 12*a* and 12*b* fixedly coupled to each other at their open ends.

The compressor assembly 14 is provided at its bottom with a pair of legs 16 and 18 and, in correspondence with them, a pair of spring seats 20 and 22 are formed on the inner bottom surface of the lower half 12*b*. Compression springs 24 and 26 are inserted over the legs 16 and 18 and the seats 20 and 24, respectively, so that the compressor assembly 14 can be elastically suspended within the closed casing 12. This suspension gives the compressor assembly 14 some extent of freedom to reciprocate in the axial direction of the compressor during the piston operation.

Separately from this, a stopper piece 28 is fixed to the inner ceiling of the upper half 12*a* in order to restrain excessive, unnecessary movement of the compressor assembly 14 within the closed casing during transportation thereof.

The compressor assembly 14 is comprised of the pumping part 30 on the rear side and the electromagnetic driving part 80 on the front side both parts lying along the axis of the compressor, which coincides with the direction of the piston reciprocation.

Figure 3:
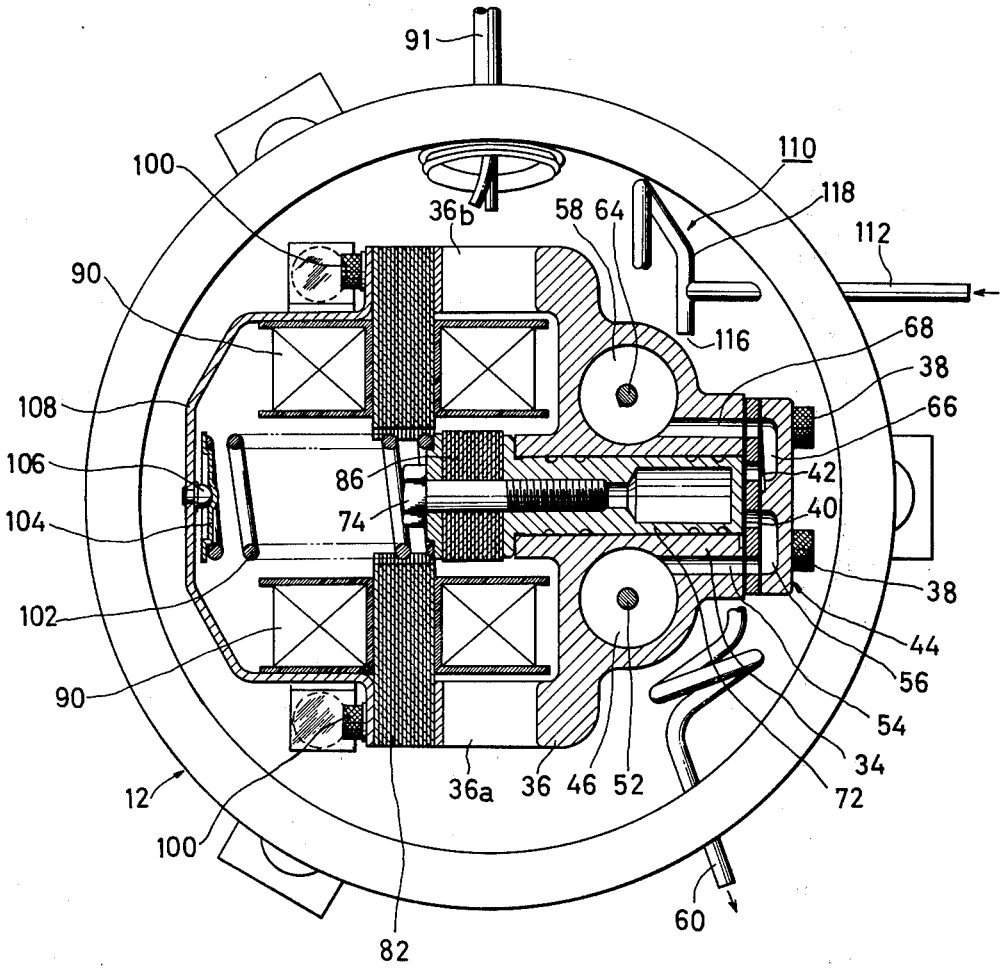
FIG. 3 is a section taken along the line 3—3 in FIG. 1.
Figure 4:
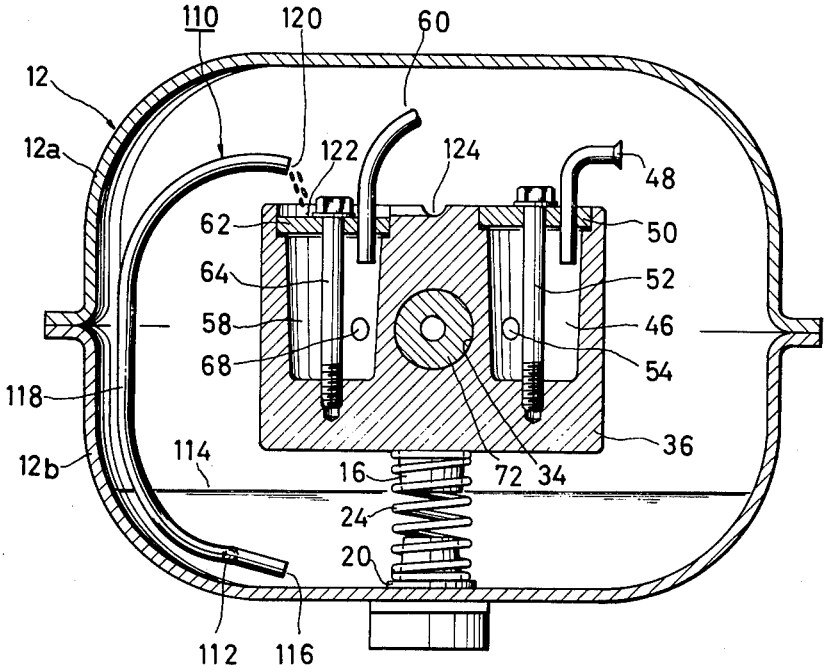
FIG. 4 is a section taken along the line 4—4 in FIG. 2.

Referring to FIGS. 3 and 4, the pumping part 30 includes, as major elements, a main body 36 having a cylindrical part 34 and a cylinder head 44 fixed to the rear end of the cylindrical part 34 by screws 38. The cylindrical part 34 defines a piston chamber in which a later described piston 72 reciprocates in order to compress the cooling gas. The cylinder head 44 is internally provided with a suction valve 40 for introducing the cooling gas into the piston chamber and a discharge valve 42 for delivering the cooling gas out of the piston chamber.

A suction chamber 46 and a discharge chamber 58 is formed in the main body 36 on opposite lateral sides of the piston chamber.

As can best be seen in FIG. 4, the upper opening of the suction chamber 46 is covered by a closure 50 via a set bolt 52 screwed into the bottom of the chamber 46 and a suction pipe 48 extends through the closure 50 while opening in the chamber 46 in order to introduce the cooling gas prevailing in the closed casing 12 into the suction chamber 46. A suction port 56 is formed in the cylinder head 44 in communication with the piston chamber via the suction valve 40 and with the above-described suction chamber 46 via a suction hole 54 formed through the main body 36. Thus, following the piston action, the cooling gas introduced into the suction chamber 46 flows into the piston chamber through the suction hole 54, the suction port 56 and the suction valve 40 in the open state.

The upper opening of the discharge chamber 58 is covered by a closure 62 via a set bolt 64 screwed into the bottom of the chamber 58 and a discharge pipe 60 extends through the closure 62 while opening in the chamber 58 in order to deliver the compressed cooling gas out of the discharge chamber 58. A discharge port 66 is formed in the cylinder head 44 on the opposite side of the suction port 56 with respect to the compressor axis in communication with the piston chamber via the discharge valve 42 and with the above-described discharge chamber 58 via a discharge hole 68 formed through the main body 36. Thus, following the piston action, the cooling gas compressed in the piston chamber flows into the discharge chamber 58 through the discharge valve 42, the discharge port 66 and the discharge hole 68.

In connection with the above-described closure 62 for the discharge chamber 58, it is necessary that the upper surface of the closure 62 should be recessed below the surrounding surfaces of the main body 36 so that the recess should function as an oil reservoir 122 of the lubrication mechanism 110 which will be later explained in more detail.

Figure 5:
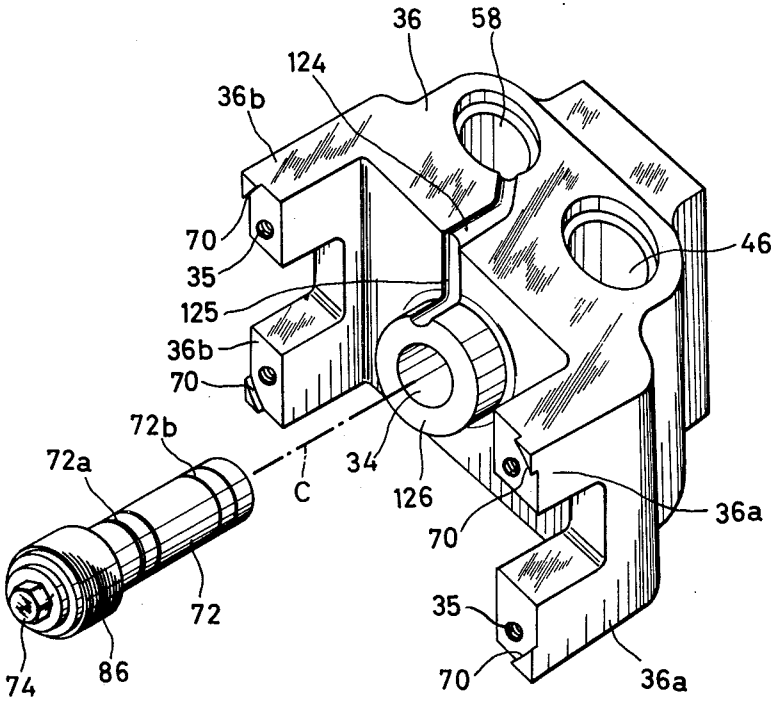
FIG. 5 is a perspective plan view of the piston and its related major parts.

As shown in FIG. 5, the main body 36 is provided on its front end with two pairs of projections 36*a*, 36*a* and 36*b*, 36*b* each projection having a seat 70 for receiving the electromagnetic driving part 80. In order to enable easy and reliable collimation of the electromagnetic driving part 80 with the pumping part 30, the pair of seats 70 arranged on a common diagonal are made symmetric to each other in their shapes and positions with respect to the center axis c of the cylindrical part 34 of the main body 36, which is shown with a chain-and-dot line in FIG. 5.

Figure 6:
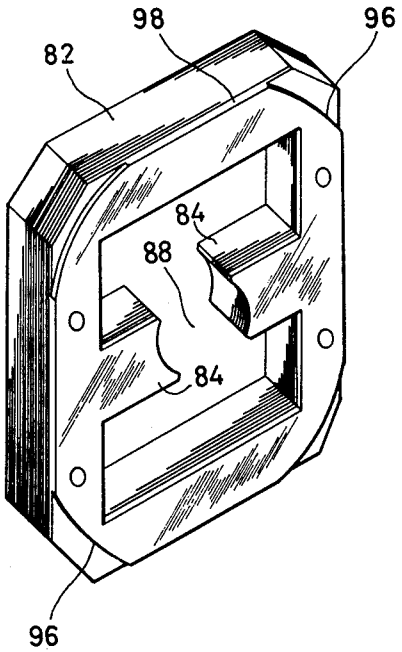

A stator core 82 forming the main part of the electromagnetic driving part 80 is comprised of a number of magnetic steel plates superimposed upon each other as shown in FIG. 6. Each of the plates has a confronting double E profile and, in the superimposed disposition, the confronting inner ends of the middle arms of the plates provides a pair of magnetic poles 84 spatially confronting to each other. The magnetic poles 84 define a column shaped magnetic field space 88 there between which space is so dimensioned as to allow free reciprocation of the later described armature 86 therethough during the pumping action. To this end, the end surfaces of the magnetic poles 84 are curved so as to conform to the circular curvature of the peripheral surface of the armature 86.

Figure 7:
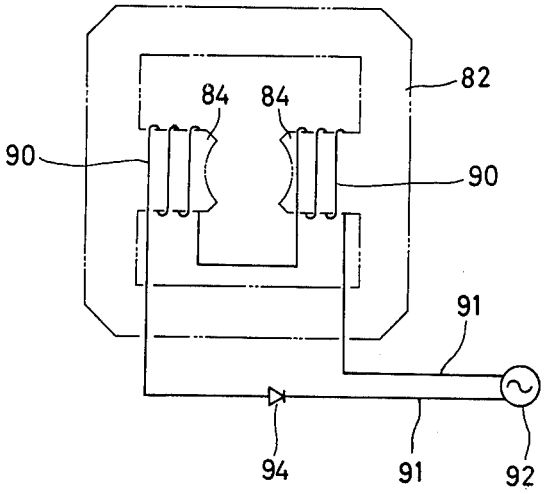
FIG. 6 is a perspective plan view of the stator core and FIG. 7 is an electric connection diagram relating to the stator core shown in FIG. 6.

As shown in FIG. 7 the magnetic poles 84 are accompanied with stator windings 90 which are connected to a given AC source 92 via a rectifier 94 by connections 91.

On the side to face front end of the main body 36, the stator core 82 is accompanied with a steel plate 98 of a rather thick construction and fitting seats 96 are formed on the four corners of the steel plate 98. The pair of seats 96 on a common diagonal are made symmetric to each other in their shapes and positions with respect to the center axis of the magnetic field space 88 of the stator core 82. It is also necessary that the shapes and positions of the four fitting seats 96 should be so designed that they come into snug engagement with the corresponding fitting seats 70 formed on the projections of main body 36 when the stator core 82 is coupled to the main body 36. It is also possible to form the fitting seats 96 directly on the rear end surface of the superimposed magnetic plates of the stator core 82 with omission of the additional steel plate 98. However, use of the steel plate 98 assures easier formation of the fitting seats by machining.

The stator core 82 is fixedly coupled to the main body 36 by set screws 100 screwed down into threaded holes 35 formed in the front surfaces of the projections 36*a* and 36*b*. (see FIGS. 3 and 5)

The above-described armature 86 is integrally joined to the front end of the piston 72 via a set screw 74 and, in the coupled disposition of the stator core 82 with the main body 36, the body of the piston 72 is axially slidably received in the piston chamber defined by the cylindrical part 34 with the stator core 82 being exposed forwards out of the main body 36 as shown in FIG. 3.

A dome-shaped supporter cover 108 is fixed to the front end of the stator core 82 by the set screws 100, and this cover 108 is provided on its inner central portion with a pivot suspension 106 which rotatably carries a spring seat 104. A compression coil spring 102 is inserted between the seat 104 and the rear end of the stator core 82.

Referring now again to FIGS. 3 and 4, the lubrication mechanism 110 utilizes a cooling gas flow returning from a cooling gas circulation system (not shown) into the closed casing 12. This lubrication mechanism 110 includes a return tube 112 extending inwardly through the lower half **12*b* of the closed casing 12 and connected to a vertical tube 118. This vertical tube 118 has a lower opening 116 at a position far below the oil level 114 and close to the interior bottom of the lower half 12*b*. The vertical tube 118 has an upper opening 120 which is positioned above the oil reservoir 122 formed by the recessed closure 62 of the discharge chamber 58**.

As shown in FIGS. 4 and 5 a horizontal oil guide 124 is formed in the upper surface of the main body 36 and, in communication with this horizontal oil guide 124, a vertical oil guide 125 is formed in the front end of the main body 36. Thus, in the case of the illustrated embodiment, the oil overflowing from the oil reservoir 122 is introduced to the sliding plane of the piston 72 with the inner surface of the cylindrical part 34 via the horizontal oil guide 124, the vertical oil guide 125, the outer periphery of the cylindrical part 34 and the front end face 126 of the cylindrical part 34.

As an alternative for this lubrication system, an oil conduit may be formed in the main body 36 in such an arrangement that the conduit opens on one hand upwardly in the upper surface of the main body 36 and on the other hand downwardly in one terminal of the cylindrical part 34. In this case, however, it is required that such a conduit should be formed at a position in the main body 36 as remote from the piston chamber as possible so that smooth downward flow of the oil should not be hindered by pressure of the gas leaking from the chamber.

As shown in FIG. 5, the piston 72 is provided with a pair of annular grooves **72*a* and 72*b* spaced from each other along the length of the piston 72. The front side groove 72*a* extends beyond the cylindrical part 34 during the forward movement of the piston 72 and receives the oil flowing down from the overhead oil reservoir 122. Upon the rearward movement of the piston 72, the oil so accomodated in the front side groove 72*a* is brought into the interior of the cylindrical part 34 for lubrication of the sliding plane. The rear side groove 72*b*** functions as an oil reservoir in order to effectively hinder leakage of the cooling gas from the piston chamber.

The compressor in accordance with the present invention and having the above-described construction operates in the following fashion.

As the stator core 82 is excited by the AC source, an electromagnetic attraction is developed between the stator core 82 and the armature 86 and the piston 72 with the armature 86 moves forwards in the piston chamber while overcoming the repulsion by the spring 102. This forward movement of the piston 72 causes lowering of the gas pressure in the piston chamber, the suction valve 40 opens and the cooling gas in the closed casing 12 in introduced into the piston chamber via the suction pipe 48, the suction chamber 46, the suction hole 54, the suction port 56 and the suction valve 40 now in the open state. The discharge valve 42 remains closed during this procedure as the gas pressure in the discharge port 66 prevails over that in the piston chamber.

As the exciting of the stator core 82 is cancelled, the electromagnetic attraction disappears and the piston 72 is placed under the influence of the repulsion force exerted by the spring 102. That is, the spring 102 forces the piston 72 to move rearwards in the piston chamber and this rearward movement of the piston 72 causes escalation of the gas pressure in the piston chamber. Thus the gas pressure in the piston chamber begins to prevail over that in the suction port 56 and the suction valve 40 closes. Concurrently therewith the discharge valve 42 is forced to open and the compressed gas in the piston chamber is supplied to the cooling system via the discharge valve 42 which is now in the open state, the open discharge port 66, the discharge hole 68, the discharge chamber 58 and the discharge pipe 60. After circulation through the cooling system, the cooling gas returns into the interior of the closed casing 12 via the return tube 112.

Lubrication of the piston mechanism is carried out during this returning process of the cooling gas into the interior of the closed casing 12. As the lower opening 116 of the vertical tube 118 is positioned far below the oil level 114 and the upper opening 120 far above the oil level 114, there exists a pressure difference between the two openings 116 and 120 and, due to this pressure difference, most of the gas flowing out of the return tube 112 tends to flow towards the upper opening 120 and is discharged therefrom into the interior of the closed casing 12. This prevailing gas flow towards the upper opening 120 concurrently generates suction at the lower opening 116 of the vertical tube and the oil so sucked into the vertical tube is mixed with the the return gas to assume a misty state. Keeping this misty state, fine oil particles move towards the upper opening 120 being entrained on the gas flow through the vertical tube 118 and, upon arrival at the upper opening 120, are separated from the gas flow due to the difference in the specific gravity and drop into the oil reservoir 122 formed by the upper closure 62 of the discharge chamber 58. In the case of the illustrated embodiment, the oil so received in the oil reservoir 122 gradually flows towards the sliding plane between the piston 72 and the cylindrical part 34 of the main body 36 via the oil guides 124 and 125 and the front end face 126 of the cylindrical part 34 as the piston 72 reciprocates.

As is clear from the foregoing explanation, the following advantages can be obtained through employment of the present invention.

a. As a perfect collimation is established between the cylindrical part 34 and the stator core 82 due to the symmetric arrangements of the seats 70 and of the fitting seats 96, the piston 72 and the armature 86 perform stable reciprocation while keeping precise collimation with the stator core 82. As a result, the aramture 86 is quite free of any biased load which otherwise applied thereto by the magnetic fluxes running at right angle to the moving direction of the armature 86. This assures effective elimination of harmful influence upon the life of the piston and its related parts by the biased electromagnetic load.

b. Once the seats 70 of the main body 36 and the seats 96 of the stator core 82 are set in the symmetric arrangements no special troublesome effort is needed for establishment of the collimation between the main body 36 and the stator core 82. This remarkably simplifies the work in assemblage of the compressor.

c. As the pressure difference between the two openings 116 and 120 of the vertical tube 118 is excellently utilized, lubrication of the piston and its related parts is as effective as in the case of the conventional rotary luctrication system via the crank shaft of the rotary motor. This assures a long useful operating life of the closed type cooling compressor.

d. The oil dropping from the upper opening 120 of the vertical tube 118 is once received in the oil reservoir 122 formed atop the main body 36 and supplied therefrom to the sliding plane for the piston lubrication. So, even when the supply of the oil from the vertical tube is intermittent, the oil can be uniformly supplied to the sliding plane as the oil is once stored in the reservoir and overflows out of same when the amount being dropped exceeds the reservoir capacity.

e. The oil reservoir 122 is positioned just above the discharge chamber 58. As the temperature of the compressed gas fed into the discharge chamber 58 from the piston chamber is very high, the oil stored in the oil reservoir 122 is heated so that the return gas mixing in the stored oil is driven off the stored oil. In other words, a complete separation of the gas from the lubrication oil is carried out at the oil reservoir and, on one hand, the gas so separated is taken into the compression system via the suction pipe 48. Thus, unfavourable introduction of the lubrication oil into the compression and gas circulation systems can be effectively prevented. On the other hand, the oil to be supplied to the lubrication system contains no cooling gas and, thus, the oil contained in the interior of the closed casing 12 contains substantially no cooling gas. Otherwise, the gas contained in the oil may develop numerous bubbles over the oil level as the compressor goes on its operation and the bubbles so developed may fill the interior of the closed casing 12. This clearly causes easy introduction of the lubrication oil into the compression and gas circulation systems.

f. As the compressor in accordance with the present invention is very compact in its construction, it can advantageously be used for, for example, refrigerators with reduced space necessary for installation thereof.

g. When compared with compressors of the conventional type with the rotary type cooling system, the compressor in accordance with the present invention provided for a reduced number of the mechanical parts. This fairly leads to lowered manufacturing costs and simplified mechanical maintenance.

I claim:

1. A closed-type electromagnetic compressor for use in a cooling system, said compressor comprising:

a substantially enclosed casing containing a first reservoir of lubricating oil;

a main body portion mounted in said casing, said main body portion including a cylindrical chamber adapted to receive a piston section of an armature assembly for reciprocating movement along a pumping axis;

a stator core assembly including a plurality of magnetic poles defining a magnetic field space there between, said magnetic field space being dimensioned so as to allow free reciprocating movement of said armature assembly along said pumping axis when said stator core assembly is in operational engagement with said main body portion;

means for causing reciprocation of said armature assembly along said pumping axis including means for periodically energizing said stator core assembly so as to periodically generate a magnetic field within said magnetic field space;

means for lubricating said piston portion of said armature assembly as it reciprocates within said cylindrical chamber, said lubricating means including a first vertically aligned tube having an intermediate portion coupled to and communicating with a second return tube through which a refrigerant gas is circulated, said first tube having an upper opening positioned above the level of said oil in said oil reservoir and a lower opening positioned below the level of said oil in said first oil reservoir, a second oil reservoir formed in said main body portion at a position just below said upper end opening of said first tube and sufficiently close to a compressed refrigerant gas discharge chamber formed in said main body portion to heat said oil in said second oil reservoir and thereby cause refrigerant gases in said heated oil to be removed therefrom, said lubricating means further including means for guiding said heated oil from said hollow reservoir to said piston portion of said armature assembly;

means for joining a mating face of said stator core to a mating face of said main body portion;

a first plurality of fitting seats formed on said mating face of said stator core assembly symmetrically about said pumping axis, each of said first plurality of fitting seats being formed along an arc of a circle which is coaxial with said pumping axis;

a second plurality of fitting seats formed on said mating face of said main body portion symmetrically about said pumping axis, each of said second plurality of fitting seats being formed along an arc of a second circle which is coaxial with said pumping axis, the shapes and positions of said fitting seats being chosen such that each of said first plurality of fitting seats precisely engages a differrent one of said second plurality of fitting seats whereby the central axis of said cylindrical chamber and said magnetic field space are both maintained in a position coaxial with said pumping axis.

2. A compressor as claimed in claim 1 in which the portion of said stator core assembly closest to said main body portion includes a steel plate fixed to its rear end surface and said first plurality of fitting seats are formed in said steel plate.

3. A compressor as claimed in claim 2 in which said main body portion is provided with four projections formed at the four corners of its mating surface, said second plurality of fitting seats being formed in the front ends of said projections and said first plurality of fitting seats being formed at the four corners of said mating surface of said stator core.

4. A compressor as claimed in claim 1 in which said guiding means comprises a guide formed in the outer surface of said main body portion and connecting said second oil reservoir to the front end face of a cylindrical part of said main body portion, said cylindrical part defining a portion of said cylindrical chamber, whereby oil flows from said second reservoir to said piston portion of said armature assembly under the force of gravity.

5. A compressor as claimed in claim 1 in which said guiding means comprises an oil guide conduit formed in communication with said second oil reservoir through said main body and opening into said cylindrical chamber.

6. A compressor as claimed in claim 1 in which said piston portion is provided with at least a pair of annular oil grooves formed in its outer peripheral surface, said grooves being axially spaced from each other.

7. The compressor of claim 6 wherein at least one of said piston oil grooves is adapted to extend beyond one exterior surface of said cylindrical chamber during its reciprocating movement to receive said lubricating oil.

* * * * *

UNITED STATES PATENT OFFICE

CERTIFICATE OF CORRECTION

Patent No. 4,032,264 Dated June 28, 1977

Inventor(s) Shiro Takahashi

It is certified that error appears in the above-identified patent and that said Letters Patent are hereby corrected as shown below:

On the face page of the patent, between "[21]" and "[52]", please indicate the following:

Foreign Application Priority Data

April 4, 1975 Japan ..... 50-40235

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*